US006902038B2

(12) United States Patent
Takahara

(10) Patent No.: US 6,902,038 B2
(45) Date of Patent: Jun. 7, 2005

(54) OIL DRAIN PLUG OF ENGINE

(75) Inventor: Tamotsu Takahara, 22, Shinjukutori 1-chome, Tokuyama-shi, Yamaguchi 745-0056 (JP)

(73) Assignees: Tamotsu Takahara, Tokuyama (JP); Nitto Kohki Co., Ltd., Tokyo (JP)

( * ) Notice: Subject to any disclaimer, the term of this patent is extended or adjusted under 35 U.S.C. 154(b) by 223 days.

(21) Appl. No.: 10/268,955

(22) Filed: Oct. 11, 2002

(65) Prior Publication Data

US 2003/0070876 A1 Apr. 17, 2003

Related U.S. Application Data

(63) Continuation-in-part of application No. 09/647,806, filed on Oct. 19, 2000, now abandoned.

(30) Foreign Application Priority Data

Apr. 6, 1998 (JP) ..... 10-93156

(51) Int. Cl.[7] ..... F16L 37/34

(52) U.S. Cl. ..... 184/1.5; 184/80; 184/82; 251/149.6

(58) Field of Search ..... 184/1.5, 80, 82, 184/105.1, 105.3; 251/149.6; 123/196 A, 196 R, 196 S

(56) References Cited

U.S. PATENT DOCUMENTS 1,574,234 A * 2/1926 Cumner ..... 137/271
1,659,047 A * 2/1928 Quinn ..... 184/106
1,846,877 A * 2/1932 Knapp ..... 137/351
4,354,523 A * 10/1982 Hochmuth et al. .... 137/614.18
4,386,639 A * 6/1983 Gable et al. ..... 141/351
4,530,421 A * 7/1985 Balch ..... 184/1.5
4,745,894 A * 5/1988 Laipply et al. ..... 123/196 R
4,776,430 A * 10/1988 Rule ..... 184/1.5
4,917,356 A * 4/1990 Shirdavani ..... 251/294
4,940,209 A * 7/1990 Fish ..... 251/144
5,048,578 A * 9/1991 Dorf et al. ..... 141/346
5,228,647 A * 7/1993 Ruibal Santome ..... 251/149.4
5,433,410 A * 7/1995 Foltz ..... 251/100
5,623,910 A * 4/1997 Riggle ..... 123/510
5,667,195 A * 9/1997 McCormick ..... 251/149.6
6,176,236 B1 * 1/2001 Tebbe ..... 128/202.13

* cited by examiner

*Primary Examiner*—Chong H. Kim
(74) *Attorney, Agent, or Firm*—Manabu Kanesaka

(57) ABSTRACT

A new type of plug incorporating a normally closed valve for draining oil from an oil pan of a car engine, wherein the normally closed valve is incorporated in a through hole provided as an oil draining path in a bolt type member fixed to the oil pan, an oil draining dedicated jig is assembled to the plug so as to open the normally closed valve in order to drain the oil contained in the oil pan by sucking it with a negative pressure, a movable valve disc member installed in the through hole is installed so that it is engaged with a valve seat provided near the outer end part of the through hole by a coiled spring so as to form the normally closed valve, and the tip end of the plug is made flush generally with the internal surface of the oil pan so as to prevent any structure from projecting toward the inside.

6 Claims, 4 Drawing Sheets

OIL DRAIN PLUG OF ENGINE

CROSS REFERENCE TO RELATED APPLICATION

This is a continuation-in-part application of patent application Ser. No. 09/647,806 filed on Oct. 19, 2000 now abandoned.

BACKGROUND OF THE INVENTION AND RELATED ART STATEMENT

The present invention relates to an oil drain plug for use with the oil pan of automobile engines.

Conventionally, automobile engines are provided with a mechanism for circulating lubricating oil (oil) through predetermined portions in order to allow the moving parts to move smoothly. The oil will be degraded over time with use to lose the lubricating performance desired. In addition, the oil will be contaminated by particles caused by wearing or sludge. Accordingly, the degraded oil is replaced at regular intervals (in general, at regular distances of travel about 3,000 to 5,000 km) from the viewpoint of preventing damage to the engine body and the like.

FIG. 5 is an explanatory view illustrating an example of an ordinary conventional engine having a configuration for replacing the degraded oil. Oil 100 in an oil pan 102 disposed under the crank chamber is supplied to predetermined portions by means of an oil pump 101. The oil is pressurized and fed by the oil pump 101. Then, the pressure of the oil is regulated by a regulating valve 103. Subsequently, foreign matter such as metal particles, carbon impurities, and sludge, which contaminate the oil are removed to clean the oil via a filter 104. Finally, the oil lubricates each of the portions of the engine and then returns to the oil pan 102 again. Incidentally, the oil pan 102 is generally filled with oil under normal conditions.

As described above, contaminants in the oil are filtered by the filter 104 in general in the course of circulation thereof, however, there is a limit to removing foreign matter by means of the filter. In addition, the degradation of the oil itself with time cannot be avoided. Accordingly, the oil is replaced in the following manner. A plug (drain cock) 106 is first removed from the oil drain hole (drain hole) 105, which is provided in the bottom portion of the oil pan 102 and usually closed tightly, to drain the degraded oil by gravity. Then, the oil drain hole 105 is closed by the plug and new oil is poured from the upper portion of the oil pan 102.

However, the aforementioned oil replacement is rather cumbersome in that the plug is first removed from the oil drain hole 105 and the plug is threaded into the hole again after the oil has been drained. In addition, it cannot be avoided for the operator to be smeared with the oil.

Accordingly, it is also practiced to drain the oil from the upper portion of the engine. For example, this includes a method for vacuuming the degraded oil with an elongated suction tube inserted in the attachment hole for an oil gauge, which is provided for checking the amount of the engine oil and contamination thereof. Also included is a method with the suction tube inserted in the oil filler port (these methods are hereinafter referred to as the "upper drainage methods").

However, the upper drainage methods can provide no means for checking whether the distal end of the tube has reached the bottom portion of the oil pan since the tube is inserted from above the crankshaft or other complicated mechanisms that are accommodated in a narrow limited space. For this reason or another, it is difficult to completely drain the degraded oil. Thus, it may not be found that the degraded oil has not been replaced properly until the refilled oil is checked. In an extreme case, the refilled oil may be replaced again. In addition, the upper drainage methods have not been employed widely because the methods cannot provide means for readily eliminating metal particles and the like accumulated on the bottom portion of the oil pan.

On the other hand, the method for draining the degraded oil from the bottom of the pan allows complete drainage of oil. By making use of the advantage thereof, improved methods have been suggested to solve the problem of smearing the operator with oil. For example, these methods include an oil replacement method with a permanent fixed plug having a normally closed poppet valve built therein (U.S. Pat. No. 4,745,894 and the corresponding Japanese Patent Publication No. 04-48987). Also included is an oil replacement method with a permanent fixed plug having a normally closed ball valve built therein (Japanese Patent Publication No. 08-170782).

These methods remove the existing oil drain plug 106 of a simple configuration shown in FIG. 5 and substitute for the closing plug 106 a plug (not shown) which has a normally closed valve built therein and is fixed to the oil drain hole 105. At the time of oil replacement, a jig dedicated to opening the built-in valve is attached to the plug to suck the oil 100 in the oil pan 102 under a negative pressure. Then, after the oil has been drained, the jig is removed from the plug and the built-in valve is returned to the closed position to allow new oil to be filled in the oil pan.

This method allows the oil 100 to be forcedly sucked and drained by a suction device, thereby providing a quick draining. Moreover, apart from the first plug replacement, the plug needs not to be removed nor threaded into the oil drain hole again. Furthermore, the method provides an advantage that the operator can drain the oil without being smeared therewith and the surrounding area can be prevented from being covered therewith.

However, when the inventor actually tried draining oil using the plug having the normally closed valve built therein according to the aforementioned prior-art method, it was found that the plug could be incorporated into only limited types of automobiles due to some problems that some automobiles were not adapted to have the plug attached thereto.

Accordingly, a further detailed study was made and it was found that these problems were originated from slight displacements in various mechanisms in the oil pan, which was designed in accordance with specifications different depending on the type of automobiles and which did not always require to be assembled with high accuracy.

That is, the plug having the normally closed valve built therein, disclosed in the aforementioned Japanese Patent Publication No. 08-170782, is adapted to allow oil to flow in from the periphery of the cylinder portion that accommodates the ball valve constituting the normally closed valve. Thus, the ball valve and the portion for accommodating a spring for biasing the ball valve to the normally closed position are attached to the oil pan so as to protrude into the oil pan for a certain length. In this case, presence of a structure on the axial line of the oil drain hole in the oil pan would cause the plug to be insufficiently threaded into the hole, thus resulting in defective attachment. Such a structure includes a baffle plate for preventing the oil from waving during travel, a separator, and a strainer for drawing up oil. In some cases, the plug cannot be attached to the automobile at all due to the design specification thereof. In addition, although the design specification allows the attachment of the plug, a displacement of a few millimeters occurring during the manufacture of the oil pan may make it impossible to attach the plug thereto.

In the case of the plug having the normally closed valve built therein, disclosed in U.S. Pat. No. 4,745,894, the distal end of the plug attached to the oil pan in the normally closed position is placed generally on the same plane as the bottom surface of the oil pan. Thus, this does not raise such a problem that the plug cannot be attached to the oil pan even in the presence of a structure on the axial line of the oil drain hole as described above. However, the plug according to this method is adapted to move the valve body disposed at an edge portion of the plug inside the oil pan into the oil pan to disengage the valve body from the valve seat, thus opening the valve to drain the oil. Thus, the presence of the structure mentioned above would lead to a drawback that the plug can be attached to the oil drain hole but the valve cannot be opened. Accordingly, it cannot be found that the plug cannot be opened until the oil is drained next time. This presents more detrimental effects in practice.

The present invention was developed to improve the plug having a normally closed valve built therein, which requires no removal of the plug and prevents the operator from being smeared with the oil and provides a quick draining, as described above. An object of the present invention is to provide the improved plug having a normally closed valve built therein for draining engine oil, the plug being made available to any automobiles without being affected by a slight displacement caused by the type of automobiles or the assembly of mechanisms in the oil pan.

Another object of the present invention is to provide an oil drain plug which protrudes less downwardly from the bottom of the oil pan to reduce the possibility of damaging the plug due to rubbing between the bottom of the automobile and the ground.

Still another object of the present invention is to provide an oil drain plug of a simple configuration with good mass-productivity to facilitate assembly, thereby providing an inexpensive plug.

SUMMARY OF THE INVENTION

The aforementioned objects are achieved by the oil drain plug according to the present invention.

The oil drain plug according to the present invention achieves the aforementioned objects. The engine oil drain plug according to the first aspect comprises a cylindrical bolt-type member having, on one end side thereof, a screw axis portion with a male screw formed thereon to be fixedly threaded into an oil drain hole provided on an oil pan of an internal combustion engine; a hexagonal bolt head portion, on the other end side, located outside the oil pan when the plug is fixedly threaded into the oil drain hole; an axial oil drain passage penetrating from the screw axis portion on the one end side to drain oil; and an annular valve seat provided adjacent said bolt head portion in the oil drain passage. The plug also includes a movable valve body member having a valve body portion, disposed in the oil drain passage of said cylindrical bolt-type member, for engaging said valve seat to close the oil drain passage, and being disposed so as to be movable in the oil drain passage to open the oil drain passage by displacing the valve body portion from the valve seat toward the inside of the oil pan. The plug also includes a spring member, extendedly interposed between a secured portion adjacent said one end side of the valve body and the movable valve body member, for biasing the movable valve body member to a normally closed position to allow the valve body portion thereof to be engaged with the valve seat. The oil drain plug is arranged to displace said movable valve body member against the bias of said spring member for biasing the same to the normally closed position to allow the valve body portion to be separated from the valve seat, thereby causing said oil drain passage to be opened to drain oil, wherein a distal end of said screw axis portion is provided generally on the same plane as an inner wall surface of the oil pan when said plug is fixedly threaded into the oil drain hole.

In the aforementioned configuration, the surface for engaging the valve body portion of the movable valve body member with the valve seat is preferably provided with a configuration for ensuring fluid-tight sealing to strictly prevent oil leakage. For example, a seal ring may be interposed which provides durability such as oil resistance and weather resistance. In general, the seal ring is incorporated into the valve body portion of the movable valve body member.

It is preferable to provide a displacement guide for the movable valve body member so as to stabilize the displacement of the movable valve body member and ensure a tight press fitting, to ensure against leakage of oil from said valve. For example, it is recommended to employ a configuration in which the movable valve body member is provided with a cylindrical portion integrated with the valve body portion and a guide portion acts as the enclosure for the cylindrical portion to displace in the axial direction on the inner wall of the cylindrical bolt-type member.

Incidentally, the statement that the distal end of said screw axis portion is provided generally on the same plane as the inner wall surface of the oil pan does not mean that the distal end is exactly located on the same plane in the foregoing configuration. This is only intended to avoid an aforementioned prior-art problem that structures in the oil pan interfere the attachment of the plug or the opening of the valve. Thus, it is not excluded that the distal end is adapted to slightly protrude inwardly from the inner wall surface of the oil pan without causing the foregoing problem to occur.

According to the present invention, the plug having a normally closed valve built therein according to the present invention can be attached to any type of automobiles with no problem in the same way as a simple plug which, without causing any particular problem to occur, is removed from the oil pan for replacing the oil and is attached thereto again after the oil has been drained. Moreover, the normally closed valve is opened by the displacement of the movable valve body member in the plug, whereby the valve can be opened without being affected by any structure present in the oil pan. Thus, the problem that a prior-art plug having a normally closed valve built therein was only available to a particular type of automobiles can be eliminated and the object of the present invention to allow a plug to be suitably applied to any type of automobiles can be achieved.

In the present invention according to the second aspect, in the previously mentioned aspects, the head portion of the cylindrical bolt-type member comprises a jig attachment holding portion for displacing the movable valve body member against the bias applied thereto in order to maintain the oil drain passage to an open position.

According to the invention, the open passage of the built-in normally closed valve can be maintained by the attachment of said jig, thus taking the load off the operator and particularly facilitating forced draining of oil by a negative-pressure suction device.

In the present invention according to the third aspect, as mentioned in each of the prior aspects, the annular valve seat provided adjacent the head portion in the oil drain passage of the cylindrical bolt-type member is formed by the calk-like sealing a valve seat member receives separate from said cylindrical bolt-type member to an end portion of said cylindrical bolt-type member.

The invention provides an advantage that the valve seat, which is critical to ensure prevention of oil leakage when the built-in normally closed valve is closed, can be formed from a member that is designed independently of and separately from the bolt-type member in material, shape, etc.

In the invention according to the first aspect, in each of the aforementioned aspects, the cylindrical bolt-type member is adapted to allow a spring member accommodating portion for normally biasing the movable valve body member to the closed position, a portion for accommodating the movable valve body member, and a portion for fixing the valve seat forming member to gradually increase in diameter, from one end portion toward the other end portion inside the oil pan. This gradual increase in diameter is necessary in the inner wall of the valve body member, for the reason that the wall thickness will become too thin at point X, thereby causing when the invention is installed into the oil pan and torque is applied the possibility of cracking. On the other hand, if the inner wall of the valve body member does not employ a gradual opening and the length of the bold-shape component protruding from the oil pan becomes long to compensate for the thin wall the possibility of rubbing the ground when the car is in motion. According to this invention, the spring for biasing the built-in valve to the normally closed position, the movable valve body member, and the valve seat forming member are disposed in the oil drain passage of the cylindrical bolt-type member in that order. The plug according to the present invention can be characterized by the press fitting of the end portion on the other end of the cylindrical bolt-type member so as to fix the valve seat forming member. This facilitates the manufacturing of the oil drain plug, thus improving productivity and providing the plug at lower costs than were possible with prior inventions.

DETAILED DESCRIPTION OF PREFERRED EMBODIMENTS

An embodiment of the present invention will be explained below in more detail with reference to the drawings.

Figure 1:
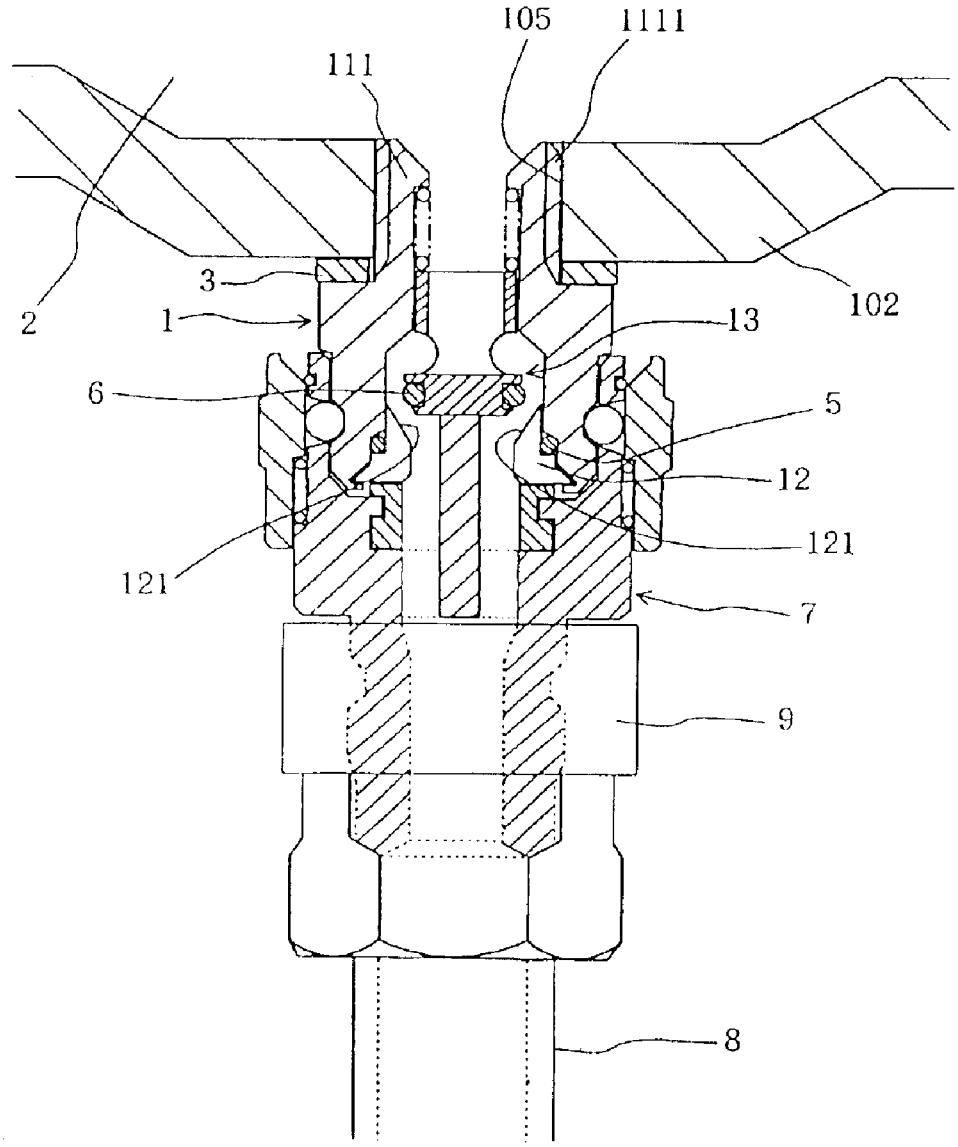
FIG. 1 is a longitudinal sectional view illustrating an oil drain plug according to an embodiment of the present invention attached to an oil drain hole of an oil pan, in which an oil drain dedicated jig is attached thereto for draining oil.
Figure 2A:
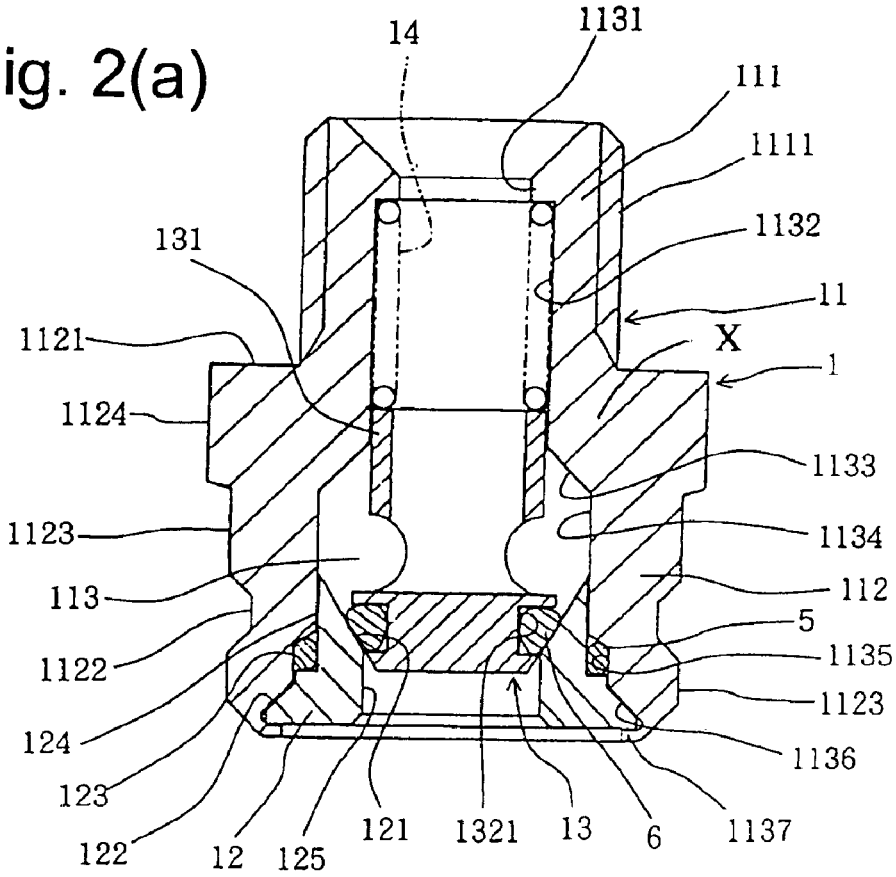
FIGS. 2(*a*)–2(*c*) are explanatory views illustrating the oil drain plug according to the aforementioned embodiment, wherein FIG. 2(*a*) is a longitudinal sectional view thereof, FIG. 2(*b*) is a perspective view showing the movable valve body member of the plug, and FIG. 2(*c*) is a perspective view showing the valve seat forming member.
Figure 2B:
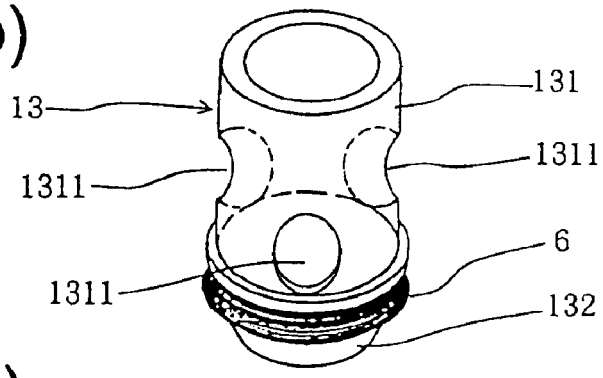
Figure 2C:
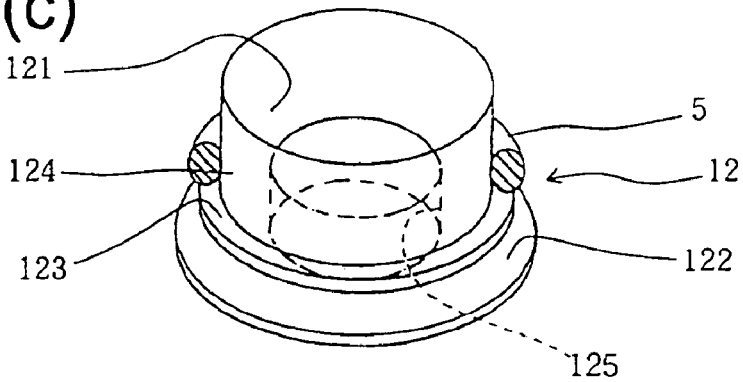
Figure 3:
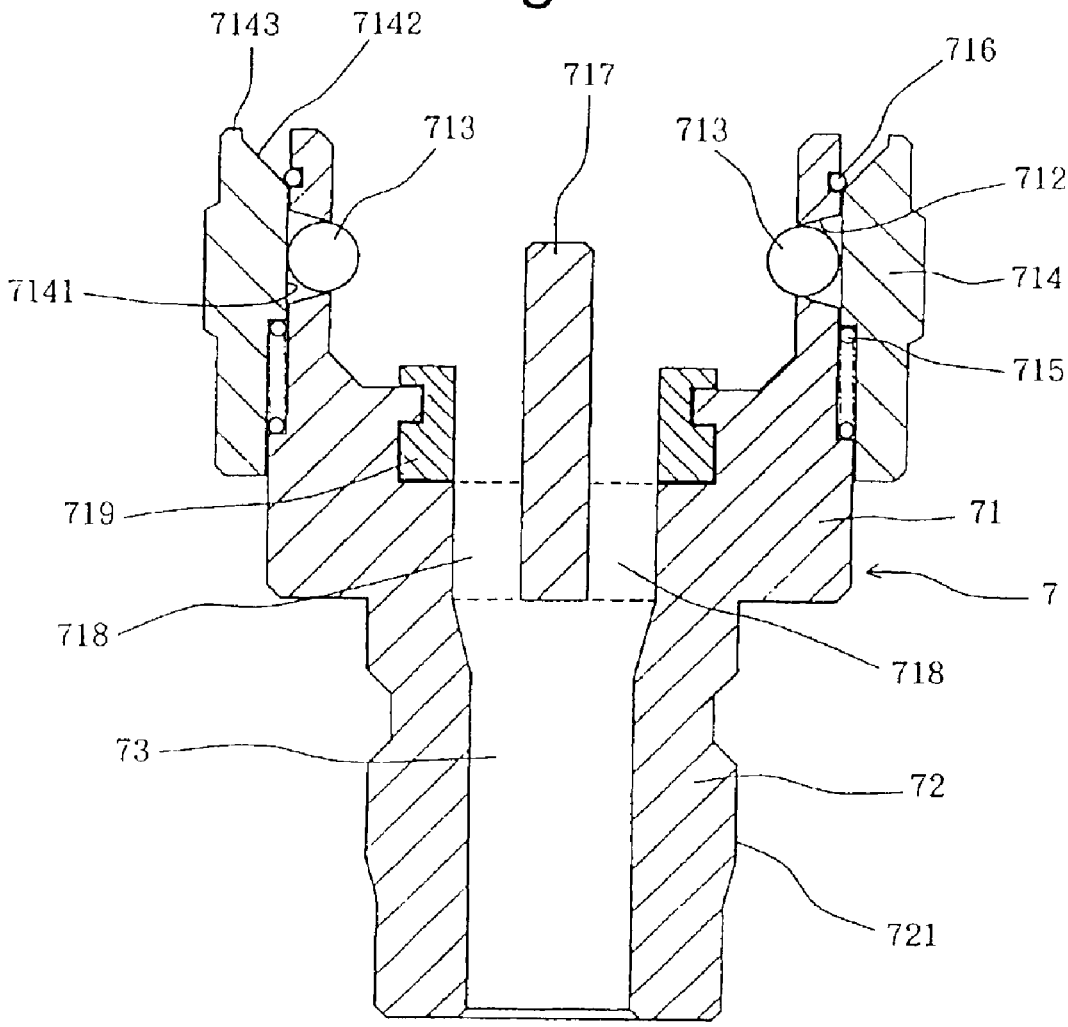
FIG. 3 is a longitudinal sectional view illustrating the dedicated jig for opening the built-in normally closed valve of the oil drain plug according to the aforementioned embodiment.
Figure 4:
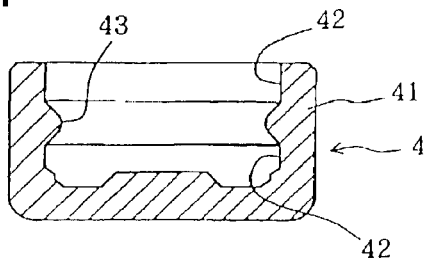
FIG. 4 is a longitudinal sectional view illustrating a cap employed for protecting the oil drain plug according to the aforementioned embodiment under usual service conditions other than at the oil replacement.

The embodiment is illustrated in FIGS. 1 to 4. FIG. 1 illustrates an oil drain plug according to the present embodiment attached to an oil pan, in which an oil drain dedicated jig is attached thereto for draining oil. FIGS. 2(*a*)–2(*c*) show explanatory views illustrating the oil drain plug according to the embodiment. FIG. 3 illustrates the dedicated jig for opening the normally closed valve of the oil drain plug according to the embodiment. FIG. 4 illustrates a cap employed for protecting the oil drain plug under usual service conditions other than the oil replacement.

Figure 5:
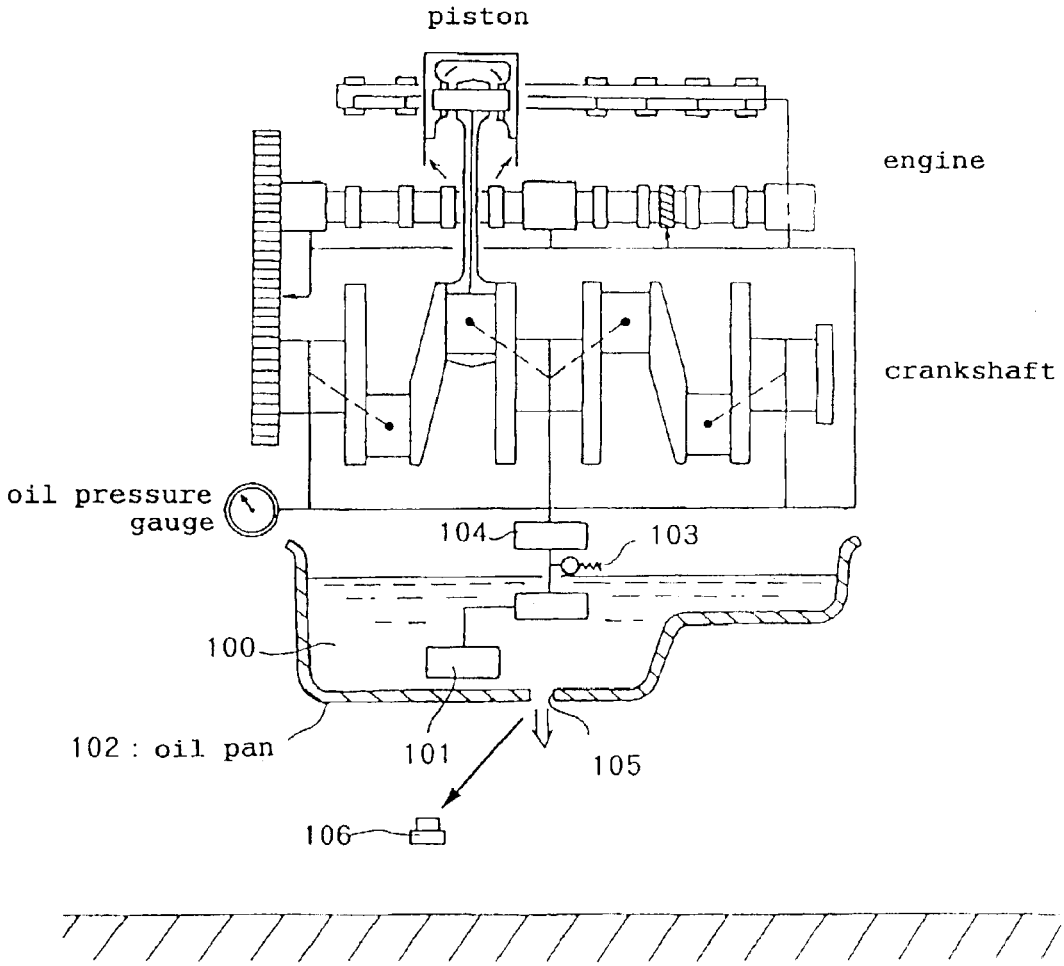
Fig. 5 Prior Art
FIG. 5 is a view illustrating a prior art method for draining oil from the oil pan of an engine to which the plug according to the present invention is applied.

Referring to FIG. 1, an oil pan is represented at 102 and an oil drain hole (female screw hole) is represented at 105 which is provided in the bottom portion of the oil pan 102. These are adapted in the same way as those of FIG. 5. The oil drain hole 105 is usually closed tightly by means of a simple closing plug (refer to reference numeral 106 of FIG. 5) which has no normally closed valve built therein. However, to use an oil drain plug 1 according to this embodiment, the aforementioned closing plug 106 is removed and then the oil drain plug 1 is threaded into the oil drain hole as later described. Reference numeral 2 designates the oil filled in the oil pan 102.

The oil drain plug 1 according to this embodiment is detailed in FIGS. 1 and 2. The oil drain plug 1 according to this embodiment includes a cylindrical bolt-type member 11 having a screw axis portion 111 on one end thereof, on which a male screw 1111 is formed; a head portion 112 communicating with the screw axis portion 111 and provided with a larger diameter on the other end; and a through-hole 113 stepped from the screw axis portion 111 to the head portion 112 (the step being larger in diameter at the bolt head portion). The oil drain plug 1 also includes a valve seat forming member 12 secured adjacent an opening on the head portion 112 side in the through-hole 113, a movable valve body member 13 disposed in the through-hole 113 so formed as to constitute an open/close valve in cooperation with a valve seat 121 formed on the valve seat forming member 12, and a coil spring 14 for biasing the movable valve body member 13 toward the valve seat 121. The through-hole 113 serves as an oil drain passage.

Now, each of the aforementioned members constituting the oil drain plug will be explained. As shown in FIG. 2(*a*), the cylindrical bolt-type member 11 has the screw axis portion 111 and the head portion 112, as mentioned above. The through-hole 113 that penetrates the cylindrical bolt-type member 11 in the axial direction is provided with the following configuration from one end portion on the screw axis portion 111 side to the other end portion on the head portion 112 side. That is, there are formed in sequence the following components: an abutment seat 1131 provided as a short flange inwardly oriented adjacent the screw axis portion 111 side at the end portion of the coil spring 14; a cylindrical inner wall surface 1132, subsequent to the abutment seat 1131, extending generally up to an intermediate portion of the cylindrical bolt-type member 11 in the axial direction thereof, serving to accommodate the coil spring 14, and slidably guiding the movable valve body member 13 in the axial direction thereof; a large diameter cylindrical surface 1134, subsequent to the cylindrical inner wall surface 1132 and extending toward the aforementioned head portion 112 via a tapered portion 1133; a tapered portion 1136, subsequent to the large-diameter cylindrical surface 1134, for affixing with a press fitting the valve seat forming member 12 provided adjacent the head portion 112 via a seal ring incorporating stepped portion 1135; and a projection 1137 for affixing with a press fitting the valve seat forming member formed on the head portion 112.

In addition, the axial dimension of the screw axis portion 111 is determined such that the distal end of the screw axis portion 111 lies generally in the same plane as the bottom surface of the oil pan 102 when the screw axis portion 111 is threaded fixedly into the oil drain hole (female screw hole) 105 of the oil pan 102 with a packing 3 disposed on the shoulder portion 1121 of the head portion 112. The head portion 112 of the plug 1 is provided, on the outer circumference thereof, with a circumferential groove 1122 which is used for fixedly holding an oil drain dedicated jig when attached thereto as later described and for fixedly holding a protective cap 4 under normal service conditions as later described as well. The head portion 112 is also provided with a guide surface 1123 having a circular cross section for incorporating the dedicated jig and the protective cap 4 to the circumferential groove 1122 and a hexagonal bolt head portion 1124, subsequent to the screw axis portion 111 and the shoulder portion 1121 of the head portion, for threading the plug into the oil drain hole.

Now, the valve seat forming member 12 in the above configuration is explained, which is detailed in FIGS. 2(*a*) and 2(*c*). That is, the valve seat-forming member 12 has a cylindrical (a ring-shaped) configuration, which is relatively short in the axial direction. As for the outer circumferential shape thereof, the member 12 is provided with a tapered outer circumferential surface 122 located adjacent the end portion on the head portion 112 side and coincident with the tapered portion 1136 for the press fitting of the cylindrical bolt-type member 11. The member 12 is also provided, subsequent to the foregoing, with a seal ring incorporating stepped portion 123 that pairs up with the seal ring incorporating stepped portion 1135 and an outer circumference surface 124 extending axially for the fitting of the large diameter cylindrical surface 1134. As for the inner circumferential shape, a cylindrical inner circumference surface 125 is positioned at the end portion side of the head portion 112 to define a passage for draining the oil. Subsequently, a tapered surface is provided which gradually enlarges the diameter of the passage so as to lead to the outer circumference surface 124. Thus, the tapered surface that gradually enlarges the diameter of the passage forms the valve seat 121. This gradual increase in diameter is necessary in the inner wall of the valve body member, for the reason that the wall thickness will become too thin at point X, thereby causing when the invention is installed into the oil pan and torque is applied the possibility of cracking. On the other hand, if the inner wall of the valve body member does not employ a gradual opening and the length of the bolt-shape component protruding from the oil pan becomes long to compensate for the thin wall the possibility of rubbing the ground when the car is in motion. Then, the valve seat forming member 12 is incorporated from the head portion 112 side of the bolt-type member 11 to allow the tapered outer circumferential surface 122 thereof to engage the fixedly calking tapered portion 1136. Thereafter, the projection 1137 for fixedly calking the valve seat forming member is calked to allow the valve seat forming member 12 to be fixed to the bolt-type member 11.

Now, the movable valve body member 13 will be explained in the aforementioned configuration. The member 13 is illustrated in FIGS. 2(*a*) and (*b*). That is, the movable valve body member 13 according to this embodiment is adapted to have a cylinder portion 131, which serves as an oil drain passage formed as the end portion on the screw axis portion 111 side, and valve body portion 132 formed as the end portion on the head portion 112 side. The cylinder portion 131 is provided with three oil passage holes 1311, communicating between the interior and exterior thereof, equally spaced apart around the circumference thereof, and each provided with a diameter suitable for draining oil.

In addition, the cylinder portion 131 is adapted to have an outer diameter so as to be slidably guided and displaced in the axial direction on the cylindrical inner wall surface 1132 of the cylindrical bolt-type member 11.

In addition, the valve body portion 132 is formed in the shape of an inverted trapezoid as shown in FIG. 2(*a*) in this embodiment, and is provided with a circumferential groove 1321 on the tapered outer circumference surface thereof. The circumferential groove 1321 is provided with a seal ring 6 which effects oil-tight sealing when seated on the valve seat 121.

Now, the method for assembling the oil drain plug 1 according to this embodiment configured as described above and the method for fixedly attaching the plug to the oil pan 102 are explained.

First, the coil spring 14 is fit into the cylindrical bolt-type member 11, to which the projection 1137 is not affixed with a press fitting, from the large opening on the head side along the cylindrical inner wall surface 1132 of the through-hole 113 such that the distal end of the coil spring 14 engages the abutment seat 1131. Then the movable valve body member 13, into which the seal ring 6 has been incorporated, is fit into the cylindrical bolt-type member 11 such that the distal end of the cylinder portion 131 engages the end portion of the coil spring 14. Thus the movable valve body member 13 is held with the coil spring 14 being compressed. Subsequently, a seal ring 5 is incorporated into the stepped portion 1135, which is to accommodate the seal ring 5, and thereafter the valve seat forming member 12 is fit into the through-hole 113 such that the tapered outer circumferential surface 122 engages the tapered portion 1136 of the through-hole 113. Then, the projection 1137 is affixed with a press fitting to the valve seat forming member 12 and the movable valve body member 13 is released. Thus the assembling procedure is completed.

As described above, the oil drain plug 1 according to this embodiment can be assembled extremely easily and provides good mass-productivity. Furthermore, the plug 1 requires less number of parts to be used and can be made available in the market at low cost. In addition, the valve seat forming member 12 can be centered by the engagement of the tapered portion thereof with the hexagonal cylindrical bolt-type member 11, thereby providing highly accurate positioning. This allows the seal ring 5 to prevent oil leakage and ensures the engagement of the seal ring 6 of the movable valve body member 13 with the valve seat 121 to prevent oil leakage, thus providing a dependable plug without oil leakage.

The plug 1 according to this embodiment assembled as described above can be fixedly incorporated into the oil pan 102 by removing the existing simple plug 106 (refer to FIG. 6) attached to the oil drain hole 105 of the oil pan 102 and thereafter threading the screw axis portion 111 into the oil drain hole 105 via the packing 3. At this time, the hexagonal bolt head portion 1124 provided on the head portion of 112 of the cylindrical bolt-type member 11 is used for the threading with a threading jig, such as a spanner.

For the plug 1 fixedly assembled as described above, the protective cap 4 shown in FIG. 4 is fitted to the end portion of the head portion 112 of the bolt-type member 11 under normal service conditions (other than at the time of draining oil). The protective cap 4 employed in this embodiment is made of rubber and is adapted to have an radial projection 43, provided on part of a barrel portion inner wall 42 of a main body 41 having a circular cross section and fitting the guide surface 1123 having a circular cross section of the valve seat forming member 12, for fitting the circumferential groove 1122 of the bolt-type member 12. However, the material and configuration of the cap are not limited to this embodiment so long as the cap can be securely attached to the end portion of the bolt-type member 12.

Now, described is a preferable method for draining oil from the oil pan 102 into which the oil drain plug 1 according to this embodiment is fixedly incorporated as described above.

The preferable method is realized using an oil drain dedicated jig 7 shown in FIG. 3 and the method for draining oil is shown in FIG. 1.

The oil drain dedicated jig 7 employed in this embodiment can be realized by a coupling that allows a fluid to start and stop flowing by attaching and detaching a general socket and plug. That is, the jig can be adapted to house a normally closed valve in one of the socket or the plug to allow a fluid to stop flowing by closing the normally closed valve when the socket and the plug are disengaged from each other, whereas allowing the fluid to start flowing by opening the normally closed valve when the socket and the plug are fittingly attached to each other.

That is, the oil drain dedicated jig 7 that is used as a socket to constitute a coupling by pairing with the plug 1 according to this embodiment includes a plug fitting portion 71, large in diameter, located on one side, and having an inner wall surface 711 of a circular cross section so as to fit to the guide surface 1123 of the head portion 112 of the plug 1. The jig 7 also comprises a coupler connecting portion 72, located on the other side, for allowing a hose 8 for sucking oil to be connected thereto. Thus, an axial through-hole leading from the plug fitting portion 71 to the coupler connecting portion 72 is formed as an oil drain passage 73.

In addition, the aforementioned plug fitting portion 71 includes an attachment and detachment switching mechanism. The mechanism is provided with ball accommodating holes 712 the accommodating diameter of which gradually increases outwardly in the radial direction so that balls are prevented from projecting more than a certain distance inwardly in the radial direction and the balls are allowed to displace outwardly. The mechanism allows the ball accommodating holes 712 and a plurality of balls 713 accommodated in the ball accommodating hole 712 to be equally spaced along the circumference thereof. The mechanism is further provided with an annular cylindrical ball displacement restricting slider 714 for restricting the outward radial displacement of the balls to two stages. The ball displacement restricting slider 714 is pressed against one end portion with a coil spring 715 provided on the outer circumference of the plug fitting portion 71 and is retained by means of an engagement ring 716. Under this condition, the slider 714 causes the balls 713 to be restrained at a position on an inner circumference surface 7141 of the slider 714, where the balls 713 are projected inwardly in the radial direction. When the slider 714 is displaced toward the other end portion against the force of the coil spring 715, a tapered surface 7142 at an end of the slider 714 is adapted to displace the balls 713 outwardly in the radial direction. Incidentally, a tip projection 7143 of the slider 714 serves to retain the balls 713.

The inner cylindrical bottom portion of the plug fitting portion 71 is provided with a push rod 717 for displacing the movable valve body member 13 to open the normally closed valve housed in the plug 1 when the dedicated jig 7 is attached to the plug 1. The push rod 717 is adapted to extend a given length toward an end portion from the central portion of a bottom portion 718 of the plug fitting portion 71 where a plurality of axial oil drain passages is bored. The extended length is determined so as to displace the movable valve body member 13 for an appropriate distance when the dedicated jig 7 is attached to the plug 1. Reference numeral 719 designates a seal member for preventing oil leakage when the dedicated jig 7 is attached to the plug 1. The seal member 719 is incorporated into the inner cylindrical bottom portion of the plug fitting portion 71 to be brought into elastic contact with an edge surface of the valve seat forming member 12 of the plug when the dedicated jig 7 is attached to the plug 1.

Incidentally, one end of the hose is fixed to a coupler 9 which is fitted to the coupler connecting portion 72, while the other end of the hose 8 is connected to a negative-pressure suction device not shown.

FIG. 1 shows the oil drain dedicated jig 7 configured as described above, attached to the plug 1, wherein the protective cap 4 of the plug 1 according to this embodiment fixedly attached to the oil pan 102 has been removed. Fitting the dedicated jig 7 to the plug causes the push rod 717 to press and displace the movable valve body member 13 of the plug 1, the valve body 132 to displace apart from the valve seat 121 to open the normally closed valve, and the seal member 719 to engage the edge surface of the valve seat forming member 12 to effect liquid-tight sealing. Accordingly, a negative pressure provided by the negative-pressure suction device (not shown) through the hose 8 will allow the oil in the oil pan 102 to be forcedly sucked and thus drained.

Furthermore, since there is no component projecting from one end of the plug 1 into the oil pan 102, the normally closed valve can be opened and closed smoothly without being restrained by the mechanism or structure of the oil pan at this time.

As described above, the present invention provides a plug having a normally closed valve built therein which needs not to be removed, which allows the operator to be hardly smeared with oil, and which provides a quick draining. It is also made possible for the first time that the plug having a normally closed valve built therein and with the same specification can be universally applied to any automobile without being affected by the type of automobile and a slight offset in attachment position of mechanisms in the oil pan.

Furthermore, the oil drain plug according to the present invention makes it possible to use a space for opening the normally closed valve and for ensuring therein the displacement of the movable valve body member or the screw axis portion as a portion for accommodating the spring biasing the valve body. Thus, this makes it possible to provide a plug shorter in length than a prior-art one described in the foregoing. This in turn allows the plug to protrude less downwardly from the bottom of the oil pan, providing reduced possibility of causing the plug to be damaged due to the rubbing between the bottom of the automobile and the ground.

Still furthermore, the oil drain plug according to the present invention provides a simplified configuration and facilitates assembly thereof to result in an improved mass-productivity, thus providing an oil drain plug at low cost.

Still furthermore, where the oil drain plug according to the present invention is attached to the bottom surface of the oil pan, the edge portion of the plug inside the oil pan can be placed on the same plane as the bottom surface of the oil pan, whereby the oil can be completely or substantially completely drained.

What is claimed is:

1. An engine oil drain plug comprising:

a cylindrical bolt member having, on one end side thereof, a screw axis portion with a male screw formed thereon to be fixedly threaded into an oil drain hole provided on an oil pan of an engine, a secured portion adjacent to the one end side, and a distal end provided on a plane substantially same as an inner wall surface of the oil pan when the engine oil drain plug is fixedly threaded into the oil drain hole; a head portion formed on the other end side, said head portion being located outside the oil pan; an axial oil drain passage penetrating from the screw axis portion on the one end side to the head portion on the other end side to drain oil and having a first diameter portion at the one end side and a second diameter portion at the other end side with a diameter greater than that of the first diameter portion; and an annular valve seat provided adjacent to the head portion in the oil drain passage and having a slant surface at an end portion thereof toward the one end side of the cylindrical bolt member with an inner diameter increasing toward the one end side of the cylindrical bolt member, a movable valve body member disposed entirely inside the oil drain passage of the cylindrical bolt member, and having a valve body portion for engaging the slant surface of the valve seat to close the oil drain passage; and a cylindrical portion slidably disposed in and supported by the first diameter portion of the oil drain passage, said cylindrical portion having an opening at an upper end, a plurality of through-holes at a lower side, and an oil path therein communicating with the opening and the through-holes so that when the valve body portion is displaced from the slant surface of the valve seat toward the inside of the oil pan, the oil can flow outwardly through the drain passage and the oil path, and a spring member interposed between the secured portion adjacent to the one end side of the cylindrical bolt member and the cylindrical portion of the movable valve body member for biasing the movable valve body member to be engaged with the slant surface of the valve seat, wherein when said movable valve body member is pushed toward the oil pan, the movable valve body member biased by the spring member to a normally closed position allows the valve body portion to be displaced from the slant surface of the valve seat, thereby opening the drain passage and the oil path.

2. An engine oil drain plug according to claim 1, wherein said head portion of the cylindrical bolt member further comprises a jig attachment holding portion for displacing the movable valve body member against a force of the spring member to maintain the drain passage and the oil path in an open position.

3. An engine oil drain plug according to claim 1, wherein said annular valve seat of the cylindrical bolt member is formed of a valve seat forming member separate from the cylindrical bolt member and is fixed to the other end side of the cylindrical bolt member by providing a press fitting, said movable valve body member being disposed so that the other end side provides a leak-proof seal.

4. An engine oil drain plug according to claim 1, wherein said screw axis portion of the cylindrical bolt member has the male screw with a screw end that is fixedly threaded into the oil pan.

5. An engine oil drain plug according to claim 4, wherein said drain passage of the cylindrical bolt member has an inclined inner wall so that the head portion is securely connected to the screw axis portion to increase an overall strength of the bolt member.

6. An engine oil drain plug according to claim 1, wherein said plurality of through-holes of the movable valve body member is located in the second portion of the drain passage, and the spring member is located in the first portion of the drain passage.

* * * * *